US011289811B2

(12) United States Patent
Wu et al.

(10) Patent No.: US 11,289,811 B2
(45) Date of Patent: Mar. 29, 2022

(54) CLOSED-LOOP ANTENNA WITH MULTIPLE GROUNDING POINTS

(71) Applicant: MediaTek Inc, Hsinchu (TW)

(72) Inventors: Tsung-Ju Wu, Hsinchu (TW); Ting-Wei Kang, Hsinchu (TW); Chung-Yu Hung, Hsinchu (TW)

(73) Assignee: MediaTek Inc.

( * ) Notice: Subject to any disclaimer, the term of this patent is extended or adjusted under 35 U.S.C. 154(b) by 277 days.

(21) Appl. No.: 16/110,506

(22) Filed: Aug. 23, 2018

(65) Prior Publication Data

US 2019/0067815 A1 Feb. 28, 2019

Related U.S. Application Data

(60) Provisional application No. 62/549,480, filed on Aug. 24, 2017.

(51) Int. Cl.

| | |
|---|---|
| ***H01Q 5/35*** | (2015.01) |
| ***H01Q 1/48*** | (2006.01) |
| ***H01Q 1/50*** | (2006.01) |
| ***H01Q 5/50*** | (2015.01) |
| ***H01Q 7/00*** | (2006.01) |
| ***H01Q 13/10*** | (2006.01) |
| ***H01Q 5/328*** | (2015.01) |

(Continued)

(52) U.S. Cl.

CPC ..... *H01Q 5/35* (2015.01); *H01Q 1/243* (2013.01); *H01Q 1/48* (2013.01); *H01Q 1/50* (2013.01);

(Continued)

(58) Field of Classification Search

CPC ..... H01Q 5/35; H01Q 13/103; H01Q 5/328; H01Q 1/243; H01Q 5/371; H01Q 7/00;

(Continued)

(56) References Cited

U.S. PATENT DOCUMENTS 10,623,029 B2 * 4/2020 Seo ..... H01Q 1/48
2012/0231750 A1 9/2012 Jin et al.

(Continued)

FOREIGN PATENT DOCUMENTS

CN 104466393 A 3/2015
CN 107210517 A 9/2017

(Continued)

OTHER PUBLICATIONS

Taiwan Intellectdual Property Office, Office Action for Taiwan Patent Application No. 107129597, dated Nov. 7, 2019.

(Continued)

*Primary Examiner* — Dimary S Lopez Cruz
*Assistant Examiner* — Michael M Bouizza
(74) *Attorney, Agent, or Firm* — Han IP PLLC; Andy M. Han

(57) ABSTRACT

Various examples and schemes pertaining to a closed-loop antenna with multiple grounding points are described. An apparatus includes an electromagnetic (EM) wave interface device capable of radiating and sensing EM waves. The EM wave interface device includes a feeding port, a first grounding port coupled to an electric ground, and a second grounding port coupled to the electric ground. A first electrically-conductive path connected between the feeding port and the first grounding port forms a closed-loop antenna. A second electrically-conductive path connected between the feeding port and the second grounding port forms a non-radiative closed-loop path. A length of the first electrically-conductive path is greater than a length of the second electrically-conductive path.

20 Claims, 18 Drawing Sheets

(51) Int. Cl.

| | |
|---|---|
| ***H01Q 1/24*** | (2006.01) |
| ***H01Q 5/371*** | (2015.01) |
| *H01Q 9/04* | (2006.01) |
| *H01Q 5/378* | (2015.01) |

(52) U.S. Cl.
CPC ..... *H01Q 5/328* (2015.01); *H01Q 5/371* (2015.01); *H01Q 5/50* (2015.01); *H01Q 7/00* (2013.01); *H01Q 13/103* (2013.01); *H01Q 5/378* (2015.01); *H01Q 9/0421* (2013.01)

(58) Field of Classification Search
CPC .. H01Q 5/50; H01Q 1/50; H01Q 1/48; H01Q 9/0421; H01Q 5/378; H04B 1/40; H04B 7/0413
See application file for complete search history.

(56) References Cited

U.S. PATENT DOCUMENTS

| | | | | |
|---|---|---|---|---|
| 2014/0062801 | A1* | 3/2014 | Yong ..... | H01Q 9/42 343/702 |
| 2015/0084817 | A1 | 3/2015 | Yong | |
| 2015/0123855 | A1 | 5/2015 | Ryu et al. | |
| 2015/0295314 | A1 | 10/2015 | Oh | |
| 2015/0325915 | A1 | 11/2015 | Lyu et al. | |
| 2017/0048363 | A1* | 2/2017 | Lee ..... | H01Q 5/328 |

FOREIGN PATENT DOCUMENTS

| | | | |
|---|---|---|---|
| CN | 206742489 | U | 12/2017 |
| CN | 108232406 | A | 6/2018 |
| CN | 108336483 | A | 7/2018 |
| CN | 207705379 | U | 8/2018 |
| JP | 2016152450 | A | 2/2015 |

OTHER PUBLICATIONS

China National Intellectdual Property Administration, Office Action for China Patent Application No. 201811396099.6, dated Dec. 16, 2020.

Taiwan Intellectual Property Office, Office Action for Taiwan Patent Application No. 107129597, dated May 6, 2021.

* cited by examiner (A)

(B)

CLOSED-LOOP ANTENNA WITH MULTIPLE GROUNDING POINTS

CROSS REFERENCE TO RELATED PATENT APPLICATION(S)

The present disclosure is part of a non-provisional application claiming the priority benefit of U.S. Patent Application No. 62/549,480, filed on 24 Aug. 2017, the content of which is incorporated by reference in its entirety.

TECHNICAL FIELD

The present disclosure is generally related to antenna design and, more particularly, to various designs of a closed-loop antenna with multiple grounding points.

BACKGROUND

Unless otherwise indicated herein, approaches described in this section are not prior art to the claims listed below and are not admitted as prior art by inclusion in this section.

As mobile communications progress from one generation to a new generation (e.g., from the 4th Generation (4G) to the 5th Generation (5G)), more bandwidth and more layers are utilized to fulfill new requirements for higher performance for the new generation of mobile communications. Correspondingly, design of the antenna(s) in a mobile communication device would need to be changed to adapt to the new requirements. There are, however, some challenge to designing new antennas such as limited area of printed circuit board (PCB) and impedance matching.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

The present disclosure proposes a number of designs, schemes, techniques, apparatuses and methods as solutions to address the aforementioned challenges.

In one aspect, an apparatus may include an electromagnetic (EM) wave interface device capable of radiating and sensing EM waves. The EM wave interface device may include a feeding port, a first grounding port coupled to an electric ground, and a second grounding port coupled to the electric ground. Moreover, a first electrically-conductive path connected between the feeding port and the first grounding port may form a closed-loop antenna. Additionally, a second electrically-conductive path connected between the feeding port and the second grounding port may form a non-radiative closed-loop path. Furthermore, a length of the first electrically-conductive path may be greater than a length of the second electrically-conductive path.

In one aspect, a method may involve wirelessly communicating using a closed-loop antenna of an EM wave interface device that comprises a feeding port, a first grounding port coupled to an electric ground, and a second grounding port coupled to the electric ground. A first electrically-conductive path connected between the feeding port and the first grounding port may form the closed-loop antenna. Moreover, a second electrically-conductive path connected between the feeding port and the second grounding port forms a non-radiative closed-loop path. In wirelessly communicating, the method may involve either or both of: (1) radiating outgoing electromagnetic waves, and (2) sensing incoming electromagnetic waves.

It is noteworthy that, although examples described herein may be in the context of certain radio access technologies, networks and network topologies such as 5G or New Radio (NR), the proposed designs, concepts, schemes and any variation(s)/derivative(s) thereof may be implemented in, for and by other types of radio access technologies, networks and network topologies such as, for example and without limitation, Long-Term Evolution (LTE), LTE-Advanced, LTE-Advanced Pro, Internet-of-Things (IoT) and Narrow Band Internet of Things (NB-IoT). Thus, the scope of the present disclosure is not limited to the examples described herein.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

Overview

Implementations in accordance with the present disclosure relate to various techniques, methods, schemes and/or solutions pertaining to sounding reference signal design with respect to user equipment and network apparatus in mobile communications. According to the present disclosure, a number of possible solutions may be implemented separately or jointly. That is, although these possible solutions may be described below separately, two or more of these possible solutions may be implemented in one combination or another.

The present disclosure proposes a number of designs of a closed-loop antenna with multiple grounding points. Specifically, a closed-loop antenna in accordance with the present disclosure may include at least a first grounding path and a second grounding path, with the first grounding path being a resonant path functioning as a closed-loop antenna path and the second grounding path functioning as a matching tuning path. In the proposed design of at least two grounding points with at least two loops, there may be a current null on a first grounding path which functions as the closed-loop antenna path (or resonant path) while a second grounding path (or matching tuning path) improves the impedance matching of the closed-loop antenna. Compared to conventional designs (such as a closed-loop antenna with a single grounding point and a planar inverted-F antenna (PIFA)) having an identical size, it is believed that the proposed closed-loop antenna with multiple grounding points would have improved performance at least in terms of antenna efficiency and scattering matrix (also known as S-parameter). Accordingly, one or more closed-loop antennas in accordance with the present disclosure (e.g., two of such antennas) may be integrated for multiple-input and multiple-output (MIMO) applications with a compact size.

Figure 1:
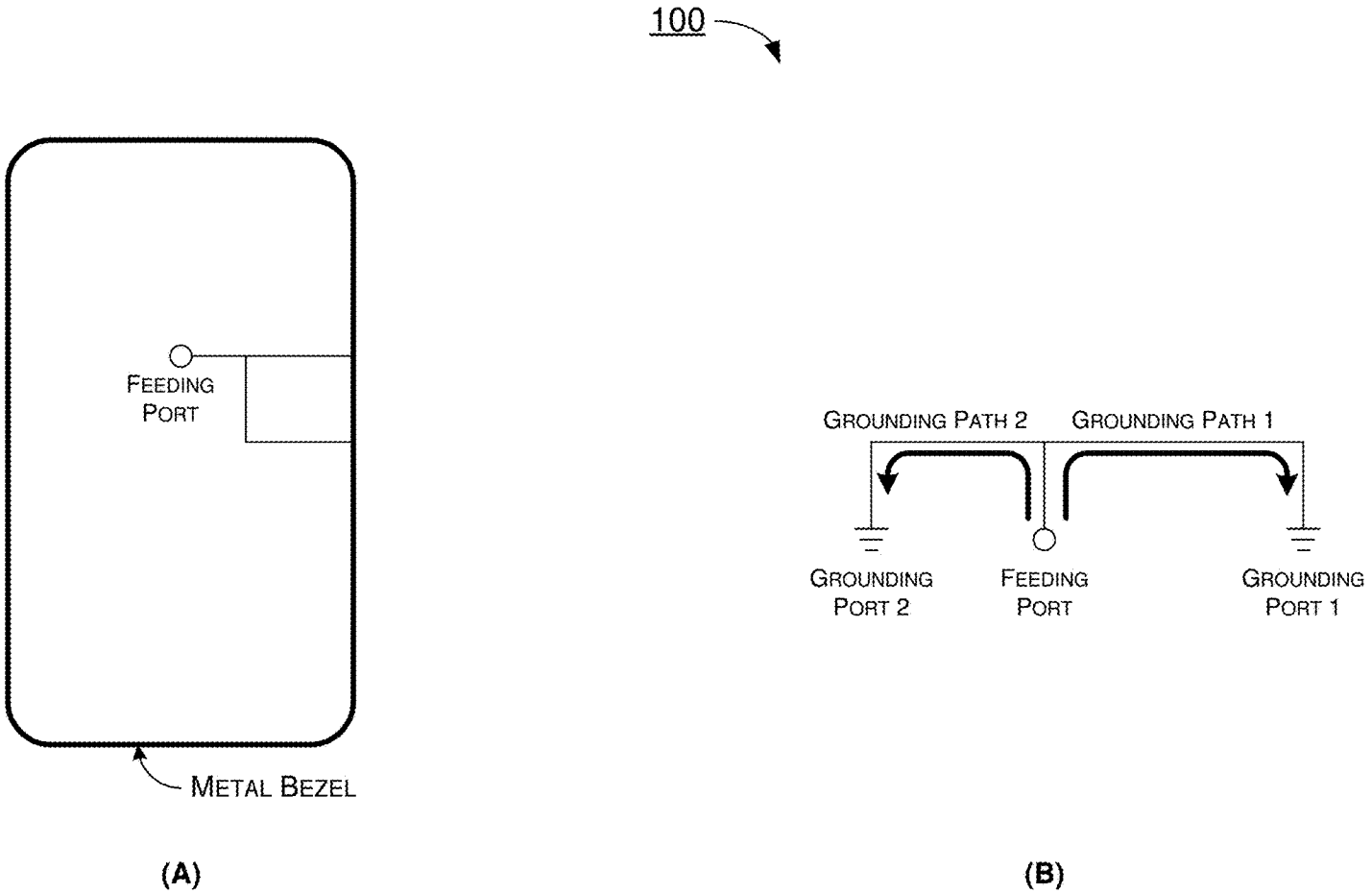
FIG. 1 is a diagram of an example design in accordance with an implementation of the present disclosure.

FIG. 1 illustrates an example design 100 in accordance with an implementation of the present disclosure. Part (A) of FIG. 1 shows an example implementation of design 100 in an apparatus (e.g., a portable apparatus such as a smartphone) with a closed-loop antenna having multiple grounding points of design 100 electrically coupled to a metal bezel of the apparatus, which is connected to a system ground. Part (B) of FIG. 1 shows a schematic diagram of design 100.

Referring to part (B) of FIG. 1, design 100 may include a feeding port and two grounding ports—namely a first grounding port and a second grounding port (shown as "grounding port 1" and "grounding port 2" in FIG. 1, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved. It is believed that design 100 may be beneficial for mobile devices using a metal bezel since there is no need for a slit on the metal bezel as part of the antenna design.

Figure 2:
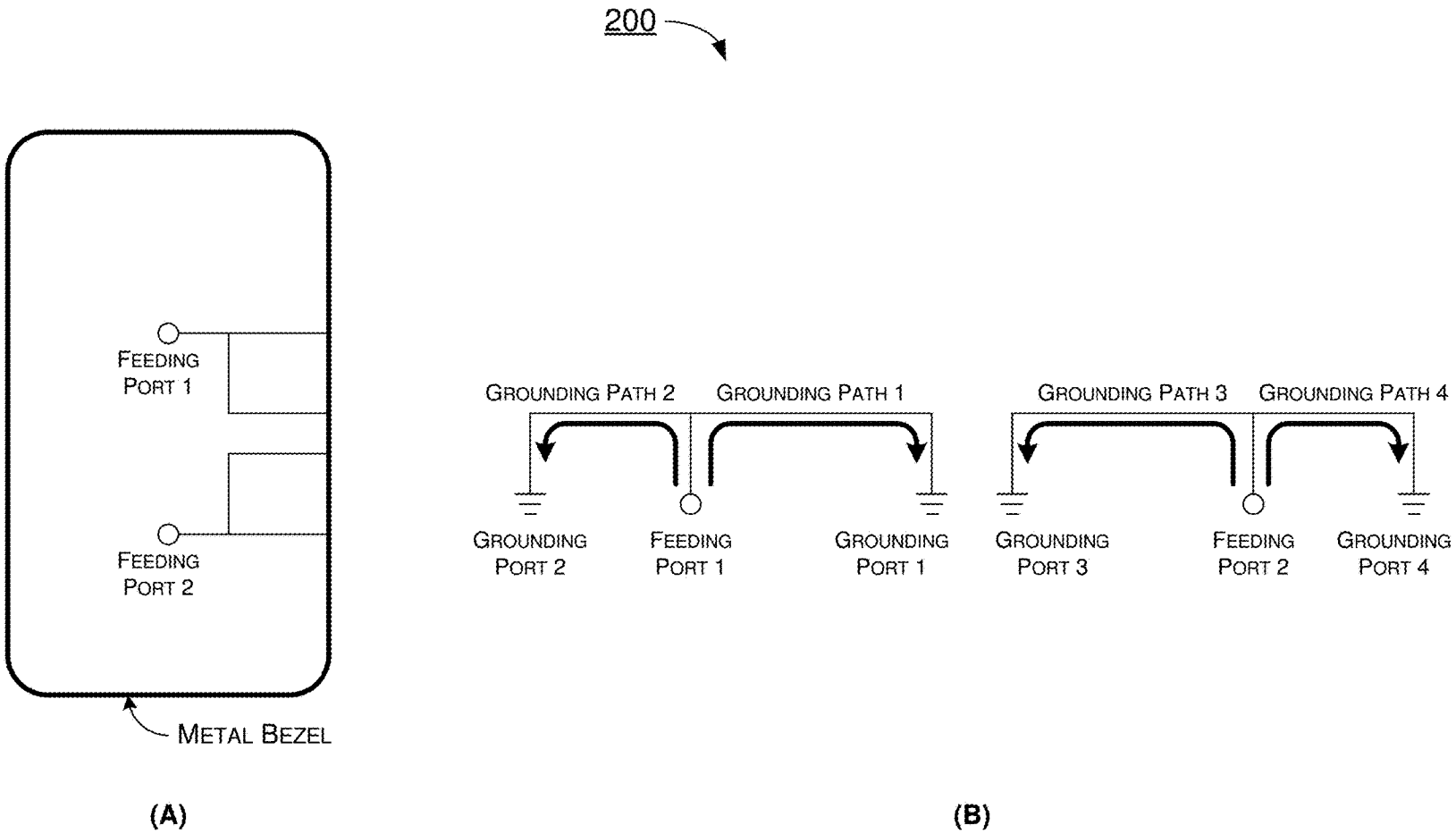
FIG. 2 is a diagram of an example design in accordance with an implementation of the present disclosure.

FIG. 2 illustrates an example design 200 in accordance with an implementation of the present disclosure. Part (A) of FIG. 2 shows an example implementation of design 200 in an apparatus (e.g., a portable apparatus such as a smartphone) with two closed-loop antennas each having multiple grounding points of design 200 electrically coupled to a metal bezel of the apparatus, which is connected to a system ground. Part (B) of FIG. 2 shows a schematic diagram of design 200.

Referring to part (B) of FIG. 2, design 200 may include two feeding ports and four grounding ports—namely a first feeding port, a second feeding port, a first grounding port, a second grounding port, a third grounding port and a fourth grounding port (shown as "feeding port 1", "feeding port 2", "grounding port 1", "grounding port 2", "grounding port 3" and "grounding port 4" in FIG. 2, respectively). A first electrically-conductive path (or a first grounding path) connected between the first feeding port and the first grounding port may form a closed-loop antenna. A second electrically-conductive path (or a second grounding path) connected between the first feeding port and the second grounding port may form a non-radiative closed-loop path. A third electrically-conductive path (or a third grounding path) connected between the second feeding port and the third grounding port may form an additional closed-loop antenna. A fourth electrically-conductive path (or a fourth grounding path) connected between the second feeding port and the fourth grounding port may form an additional non-radiative closed-loop path. The length of the first grounding path is greater than the length of the second grounding path, and the length of the third grounding path is greater than the length of the fourth grounding path. With the second grounding path and the fourth grounding path, antenna matching for each of the two closed-loop antennas may be improved.

It is noteworthy that, although two antennas are shown in design 200, there may be more than two closed-loop antennas each having multiple grounding points in various implementations. Moreover, the multiple antennas of design 200 may be utilized near or around the metal bezel for MIMO operations.

Figure 3:
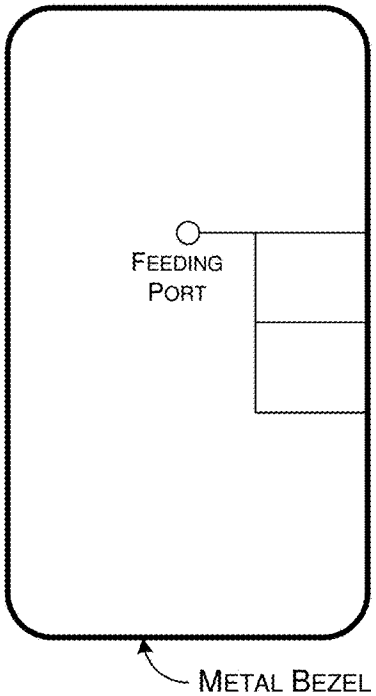
FIG. 3 is a diagram of an example design in accordance with an implementation of the present disclosure.
Figure 3:
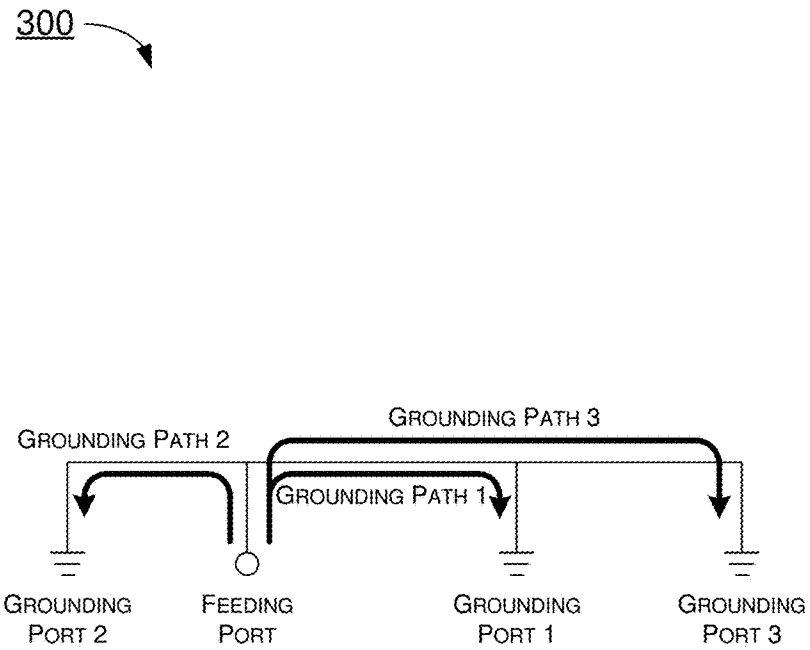

FIG. 3 illustrates an example design 300 in accordance with an implementation of the present disclosure. Part (A) of FIG. 3 shows an example implementation of design 300 in an apparatus (e.g., a portable apparatus such as a smartphone) with two closed-loop antennas each having multiple grounding points of design 300 electrically coupled to a metal bezel of the apparatus, which is connected to a system ground. Part (B) of FIG. 3 shows a schematic diagram of design 300.

Referring to part (B) of FIG. 3, design 300 may include a feeding port and three grounding ports—namely a first grounding port, a second grounding port and a third grounding port (shown as "grounding port 1", "grounding port 2" and "grounding port 3" in FIG. 3, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. A third electrically-conductive path (or a third grounding path) connected between the feeding port and the third grounding port may form an additional closed-loop antenna. The length of the first grounding path is greater than the length of the second grounding path, and the length of the third grounding path is greater than the length of the second grounding path. With the third ground path, an additional resonant mode may be formed (e.g., a first resonant mode with the first grounding path and a second resonant mode with the second grounding path).

Figure 4:
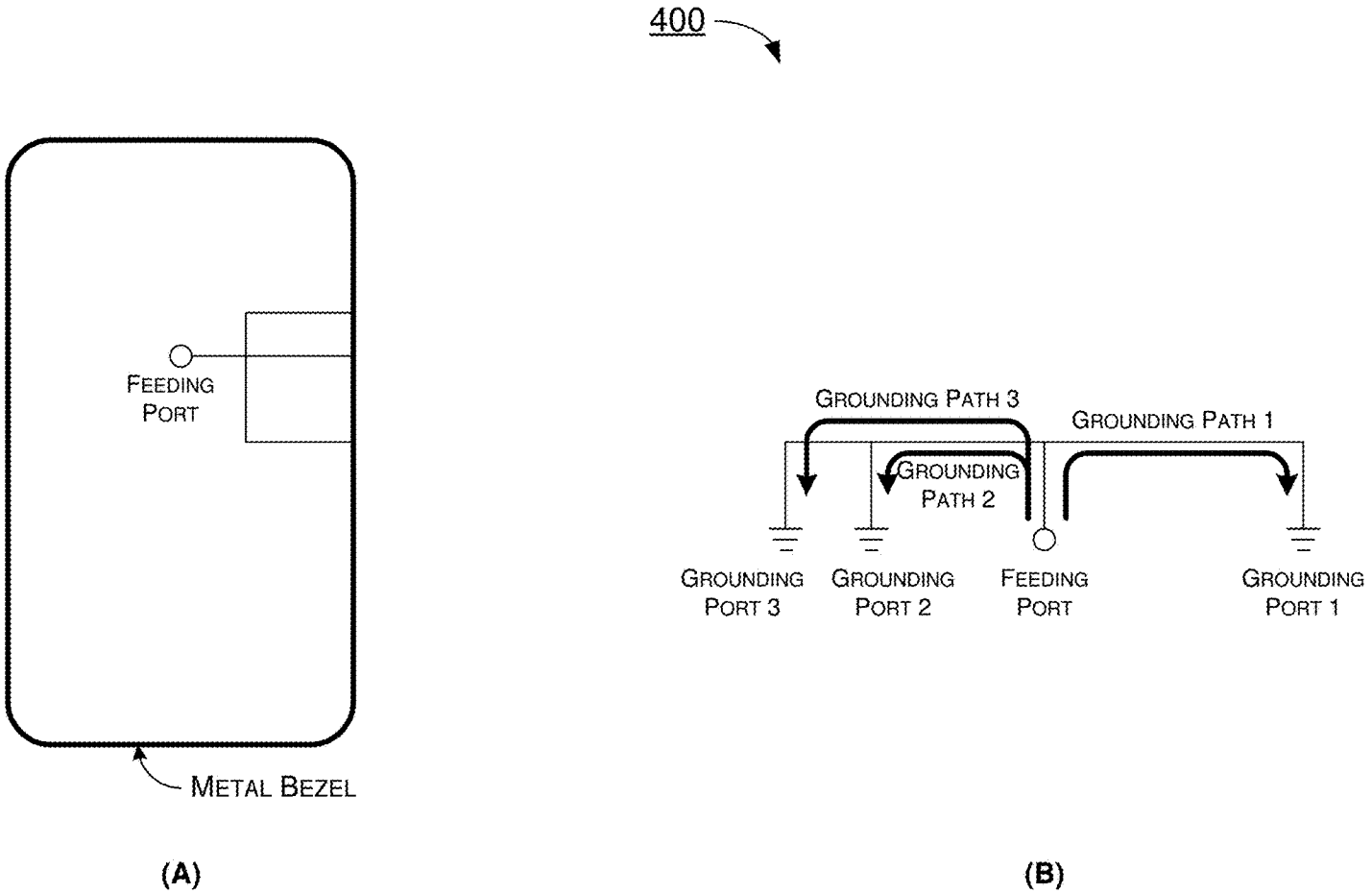
FIG. 4 is a diagram of an example design in accordance with an implementation of the present disclosure.

FIG. 4 illustrates an example design 400 in accordance with an implementation of the present disclosure. Part (A) of FIG. 4 shows an example implementation of design 400 in an apparatus (e.g., a portable apparatus such as a smartphone) with a closed-loop antenna having multiple grounding points of design 400 electrically coupled to a metal bezel of the apparatus, which is connected to a system ground. Part (B) of FIG. 4 shows a schematic diagram of design 400.

Referring to part (B) of FIG. 4, design 400 may include a feeding port and three grounding ports—namely a first grounding port, a second grounding port and a third grounding port (shown as "grounding port 1", "grounding port 2" and "grounding port 3" in FIG. 4, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. A third electrically-conductive path (or a third grounding path) connected between the feeding port and the third grounding port may form an additional non-radiative closed-loop path. The length of the first grounding path is greater than the length of each of the second grounding path and the third grounding path. With the third grounding path, matching tuning for the closed-loop antenna may be improved.

Figure 5A:
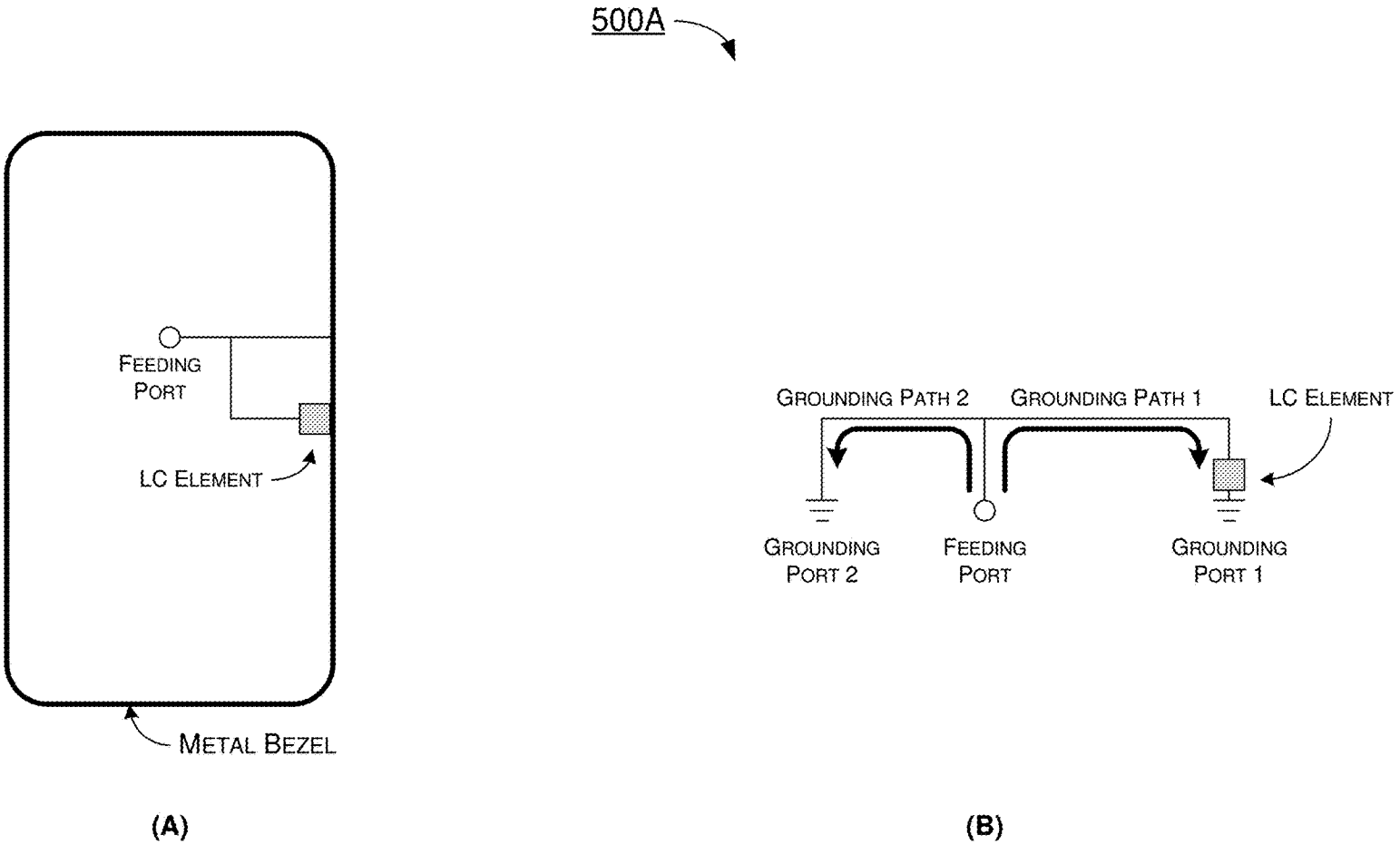
FIG. 5A is a diagram of an example design in accordance with an implementation of the present disclosure.

FIG. 5A illustrates an example design 500A in accordance with an implementation of the present disclosure. Part (A) of FIG. 5A shows an example implementation of design 500A in an apparatus (e.g., a portable apparatus such as a smartphone) with a closed-loop antenna having multiple grounding points of design 500A electrically coupled to a metal bezel of the apparatus, which is connected to a system ground. Part (B) of FIG. 5A shows a schematic diagram of design 500A.

Referring to part (B) of FIG. 5A, design 500A may include a feeding port and two grounding ports—namely a first grounding port and a second grounding port (shown as "grounding port 1" and "grounding port 2" in FIG. 5A, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved.

Different from design 100, an alternative design may include one or more resonant circuits capable of matching tuning the closed-loop antenna. Each of the one or more resonant circuits may include an LC circuit having one or more inductors (L) and capacitors (C) elements). The one or more resonant circuits may be disposed at one or more grounding points of a closed-loop antenna in accordance with the present disclosure for matching tuning. For instance, each grounding path may be configured with a respective resonant circuit. In design 500A, a resonant circuit (shown as an "LC element" in FIG. 5A) may be disposed on the first grounding path such that the feeding port is electrically connected to the first grounding port through the resonant circuit.

Figure 5B:
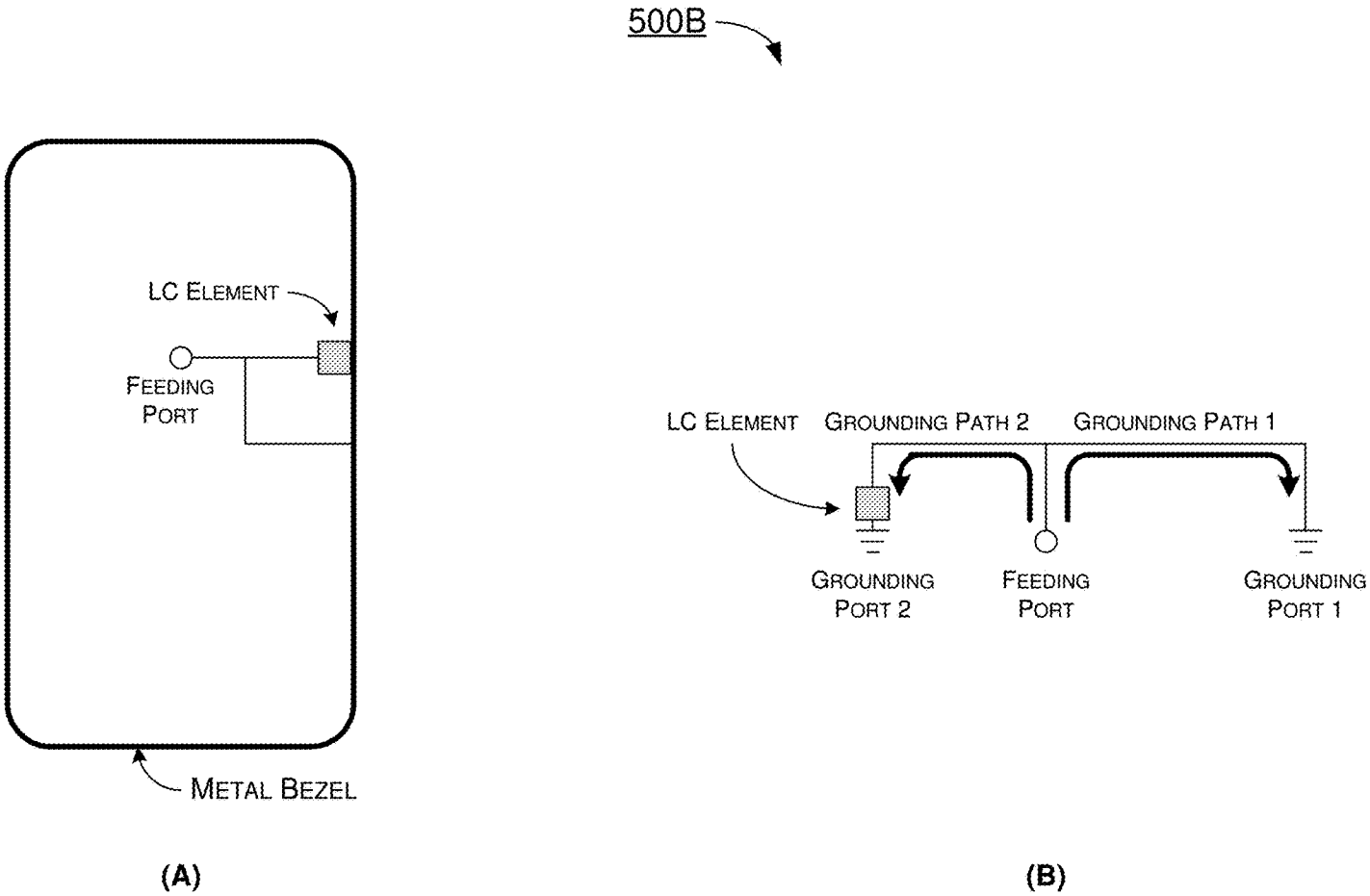
FIG. 5B is a diagram of an example design in accordance with an implementation of the present disclosure.

FIG. 5B illustrates an example design 500B in accordance with an implementation of the present disclosure. Part (A) of FIG. 5B shows an example implementation of design 500B in an apparatus (e.g., a portable apparatus such as a smartphone) with a closed-loop antenna having multiple grounding points of design 500B electrically coupled to a metal bezel of the apparatus, which is connected to a system ground. Part (B) of FIG. 5B shows a schematic diagram of design 500B.

Referring to part (B) of FIG. 5B, design 500B may include a feeding port and two grounding ports—namely a first grounding port and a second grounding port (shown as "grounding port 1" and "grounding port 2" in FIG. 5B, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved.

Different from design 100, an alternative design may include one or more resonant circuits capable of matching tuning the closed-loop antenna. Each of the one or more resonant circuits may include an LC circuit having one or more inductors (L) and capacitors (C) elements). The one or more resonant circuits may be disposed at one or more grounding points of a closed-loop antenna in accordance with the present disclosure for matching tuning. For instance, each grounding path may be configured with a respective resonant circuit. In design 500B, a resonant circuit (shown as an "LC element" in FIG. 5B) may be disposed on the second grounding path such that the feeding port is electrically connected to the second grounding port through the resonant circuit.

Figure 6:
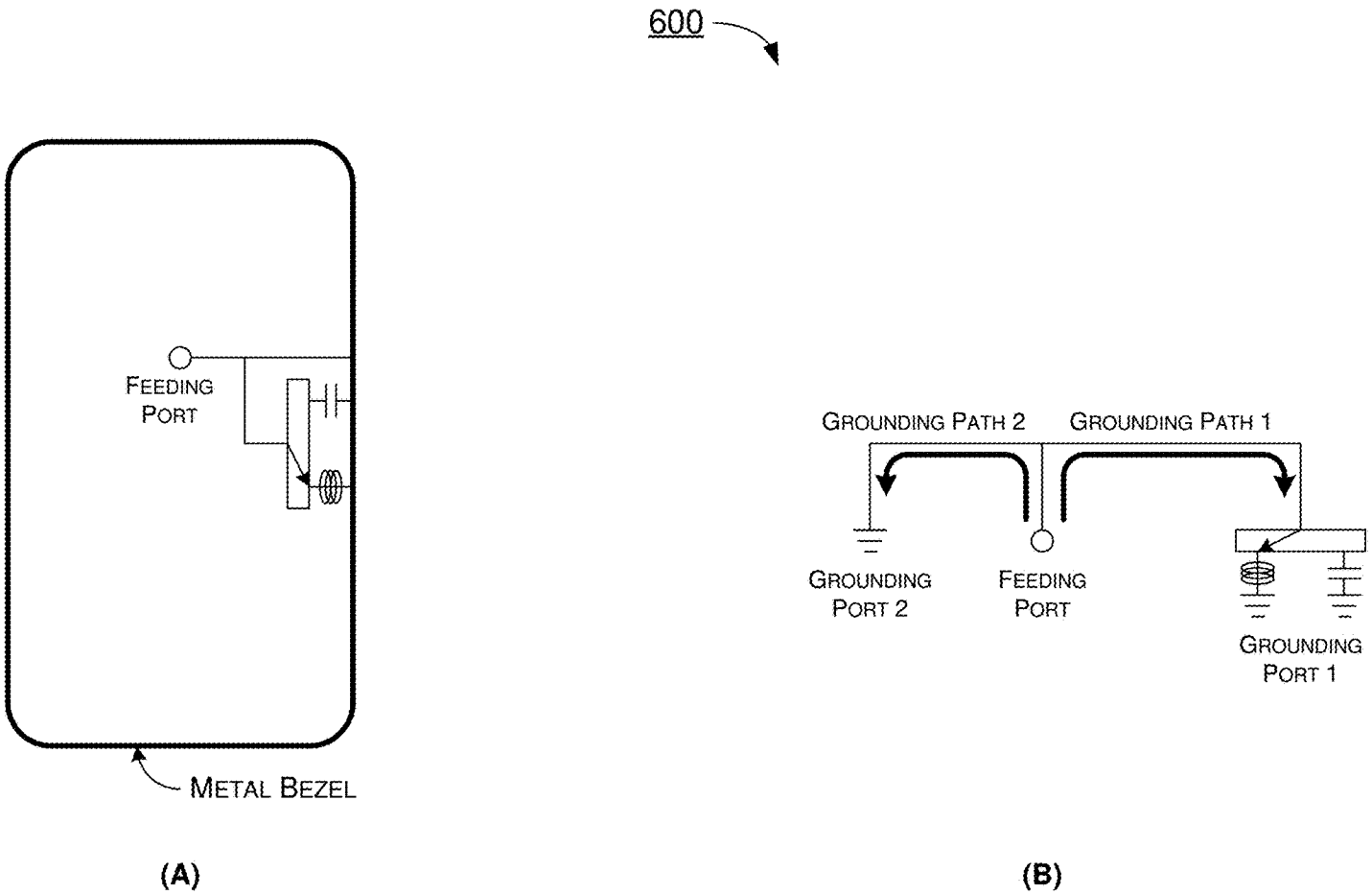
FIG. 6 is a diagram of an example design in accordance with an implementation of the present disclosure.

FIG. 6 illustrates an example design 600 in accordance with an implementation of the present disclosure. Part (A) of FIG. 6 shows an example implementation of design 600 in an apparatus (e.g., a portable apparatus such as a smartphone) with a closed-loop antenna having multiple grounding points of design 600 electrically coupled to a metal bezel of the apparatus, which is connected to a system ground. Part (B) of FIG. 6 shows a schematic diagram of design 600.

Referring to part (B) of FIG. 6, design 600 may include a feeding port and two grounding ports—namely a first grounding port and a second grounding port (shown as "grounding port 1" and "grounding port 2" in FIG. 6, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved. It is believed that design 600 may be beneficial for mobile devices using a metal bezel since there is no need for a slit on the metal bezel as part of the antenna design.

In design 600, the first grounding path may be configured with a switching circuit capable of setting or otherwise selecting or switching a frequency band at which the closed-loop antenna operates to one of a plurality of frequency bands. For instance, the feeding port may be electrically connected to the first grounding port through the switching circuit. The switching circuit may include a single-pole multiple-throw (SPnT) switch, where n is a positive integer equal to or greater than 2. In the example shown in FIG. 6, a single-pole double-throw (SP2T) switch is shown although another switching circuit such as SP3T or SP4T switch may be used.

Figure 7:
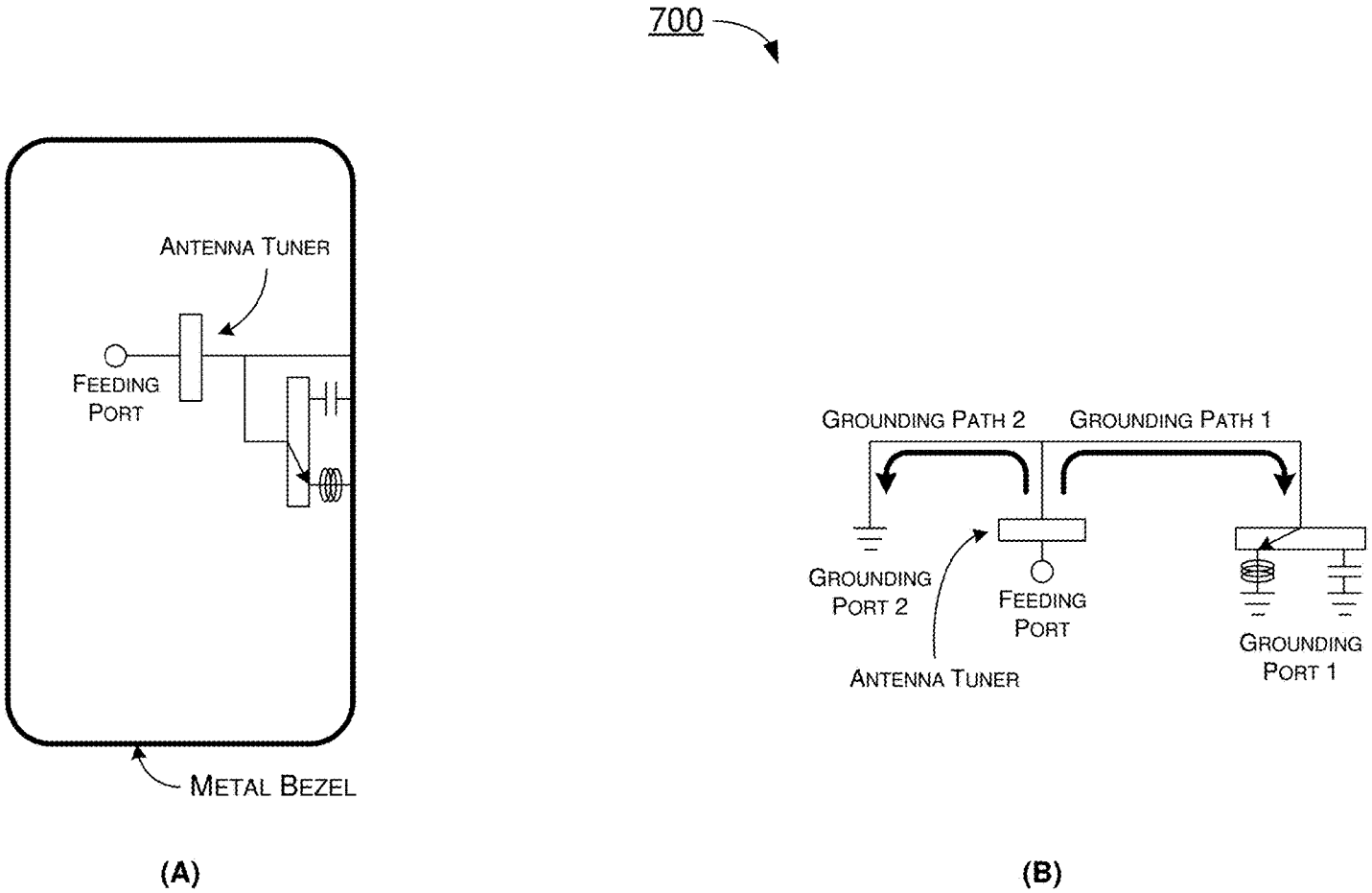
FIG. 7 is a diagram of an example design in accordance with an implementation of the present disclosure.

FIG. 7 illustrates an example design 700 in accordance with an implementation of the present disclosure. Part (A) of FIG. 7 shows an example implementation of design 700 in an apparatus (e.g., a portable apparatus such as a smartphone) with a closed-loop antenna having multiple grounding points of design 700 electrically coupled to a metal bezel of the apparatus, which is connected to a system ground. Part (B) of FIG. 7 shows a schematic diagram of design 700.

Referring to part (B) of FIG. 7, design 700 may include a feeding port and two grounding ports—namely a first grounding port and a second grounding port (shown as "grounding port 1" and "grounding port 2" in FIG. 7, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved. It is believed that design 700 may be beneficial for mobile devices using a metal bezel since there is no need for a slit on the metal bezel as part of the antenna design.

In design 700, the first grounding path may be configured with a switching circuit capable of setting or otherwise selecting or switching a frequency band at which the closed-loop antenna operates to one of a plurality of frequency bands. For instance, the feeding port may be electrically connected to the first grounding port through the switching circuit. The switching circuit may include a single-pole multiple-throw (SPnT) switch, where n is a positive integer equal to or greater than 2. In the example shown in FIG. 7, a single-pole double-throw (SP2T) switch is shown although another switching circuit such as SP3T or SP4T switch may be used.

Moreover, design 700 may also include an antenna tuner capable of adaptive antenna tuning for the closed-loop antenna. The antenna tuner may be disposed close to or near the feeding port. For instance, the antenna tuner may be coupled between the feeding port and the switching circuit and the first grounding port as well as between the feeding port and the second grounding port.

Figure 8:
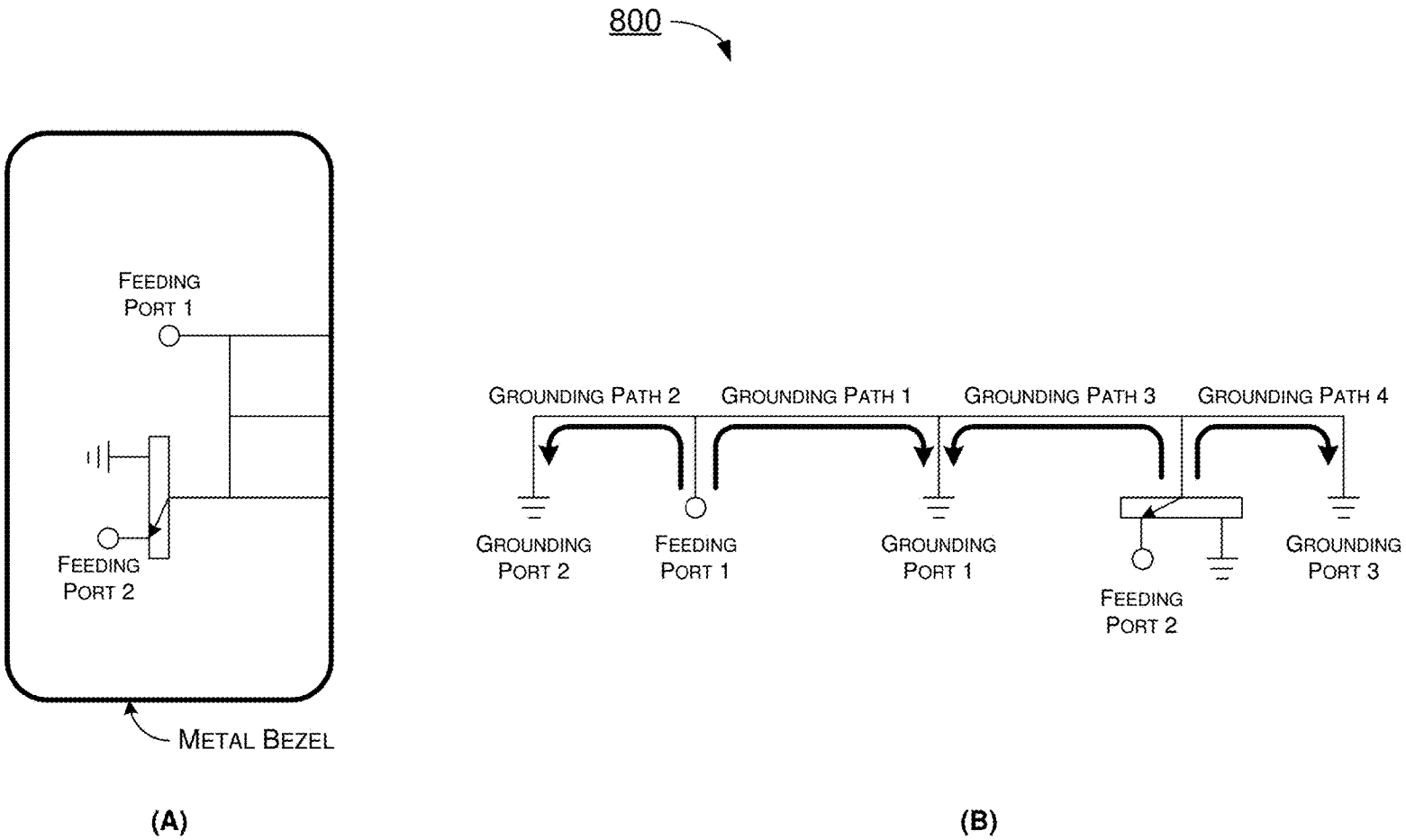
FIG. 8 is a diagram of an example design in accordance with an implementation of the present disclosure.

FIG. 8 illustrates an example design 800 in accordance with an implementation of the present disclosure. Part (A) of FIG. 8 shows an example implementation of design 800 in an apparatus (e.g., a portable apparatus such as a smartphone) with a closed-loop antenna having multiple grounding points of design 800 electrically coupled to a metal bezel of the apparatus, which is connected to a system ground. Part (B) of FIG. 8 shows a schematic diagram of design 800.

Referring to part (B) of FIG. 8, design 800 may include a feeding port, an additional feeding port, and three grounding ports—namely a first grounding port, a second grounding port and a third grounding port (shown as "feeding port 1", "feeding port 2", "grounding port 1", "grounding port 2" and "grounding port 3" in FIG. 8, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. A third electrically-conductive path (or a third grounding path) connected between the additional feeding port and the first grounding port may form an additional closed-loop antenna. A fourth electrically-conductive path (or a fourth grounding path) connected between the additional feeding port and the third grounding port may form an additional non-radiative closed-loop path. The length of the first grounding path is greater than the length of the second grounding path. Similarly, the length of the third grounding path is greater than the length of the fourth grounding path.

With design 800, the two closed-loop antennas may have at least two operational modes with aid of active elements. For instance, design 800 may also include a switching circuit. The third grounding path and the fourth grounding path may be selectively connected to either the additional feeding port or the electric ground through the switching circuit. The switching circuit may include a single-pole multiple-throw (SPnT) switch, where n is a positive integer equal to or greater than 2. In the example shown in FIG. 7, a single-pole double-throw (SP2T) switch is shown although another switching circuit such as SP3T or SP4T switch may be used.

Figure 9:
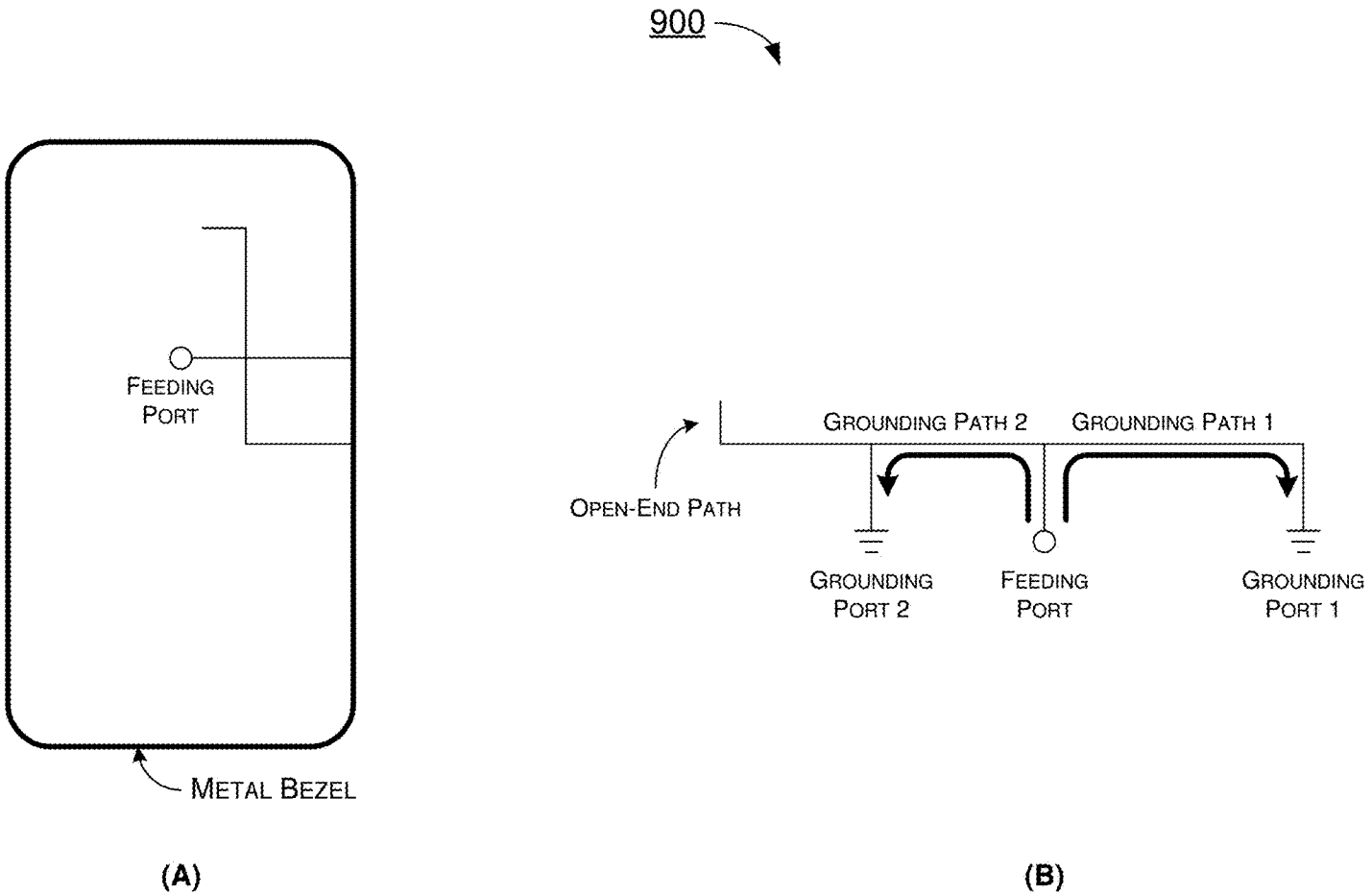
FIG. 9 is a diagram of an example design in accordance with an implementation of the present disclosure.

FIG. 9 illustrates an example design 900 in accordance with an implementation of the present disclosure. Part (A) of FIG. 9 shows an example implementation of design 900 in an apparatus (e.g., a portable apparatus such as a smartphone) with a closed-loop antenna having multiple grounding points of design 900 electrically coupled to a metal bezel of the apparatus, which is connected to a system ground. Part (B) of FIG. 9 shows a schematic diagram of design 900.

Referring to part (B) of FIG. 9, design 900 may include a feeding port and two grounding ports—namely a first grounding port and a second grounding port (shown as "grounding port 1" and "grounding port 2" in FIG. 9, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved. It is believed that design 900 may be beneficial for mobile devices using a metal bezel since there is no need for a slit on the metal bezel as part of the antenna design.

Design 900 may also include an electrically-conductive open-end path extending from the feeding port. The open-end path may function as a tuning stub or a monopole antenna. It is believed the structure of design 900 may improve efficiency of the closed-loop antenna.

Figure 10A:
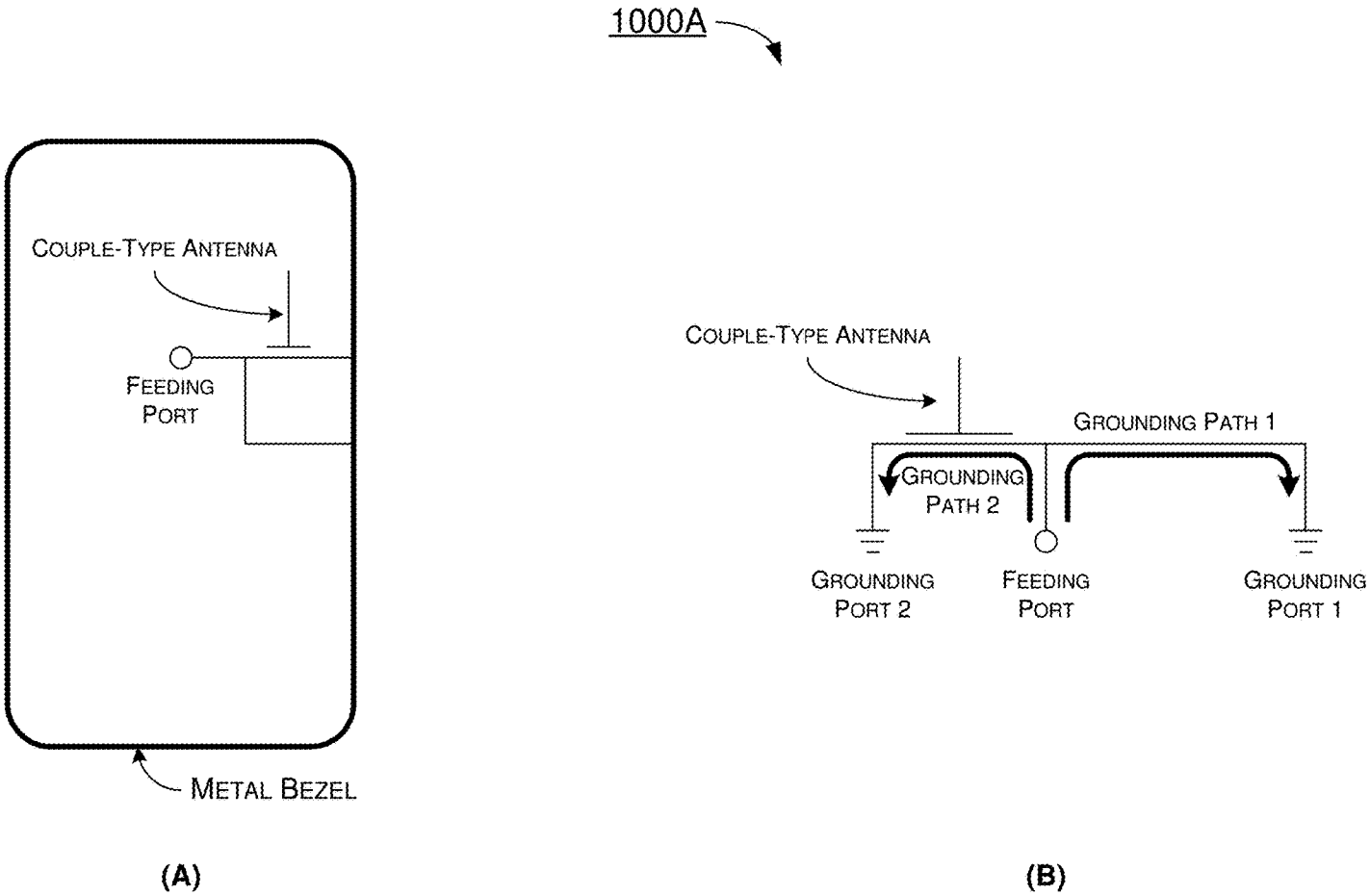
FIG. 10A is a diagram of an example design in accordance with an implementation of the present disclosure.

FIG. 10A illustrates an example design 1000A in accordance with an implementation of the present disclosure. Part (A) of FIG. 10A shows an example implementation of design 1000A in an apparatus (e.g., a portable apparatus such as a smartphone) with a closed-loop antenna having multiple grounding points of design 1000A electrically coupled to a metal bezel of the apparatus, which is connected to a system ground. Part (B) of FIG. 10A shows a schematic diagram of design 1000A.

Referring to part (B) of FIG. 10A, design 1000A may include a feeding port and two grounding ports—namely a first grounding port and a second grounding port (shown as "grounding port 1" and "grounding port 2" in FIG. 10A, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved. It is believed that design 1000A may be beneficial for mobile devices using a metal bezel since there is no need for a slit on the metal bezel as part of the antenna design.

Design 1000A may also include an electrically-conductive open-end path capacitively coupled to the second grounding path. The open-end path may function as a couple-type antenna that supports the closed-loop antenna to wirelessly communication in more frequency bands.

Figure 10B:
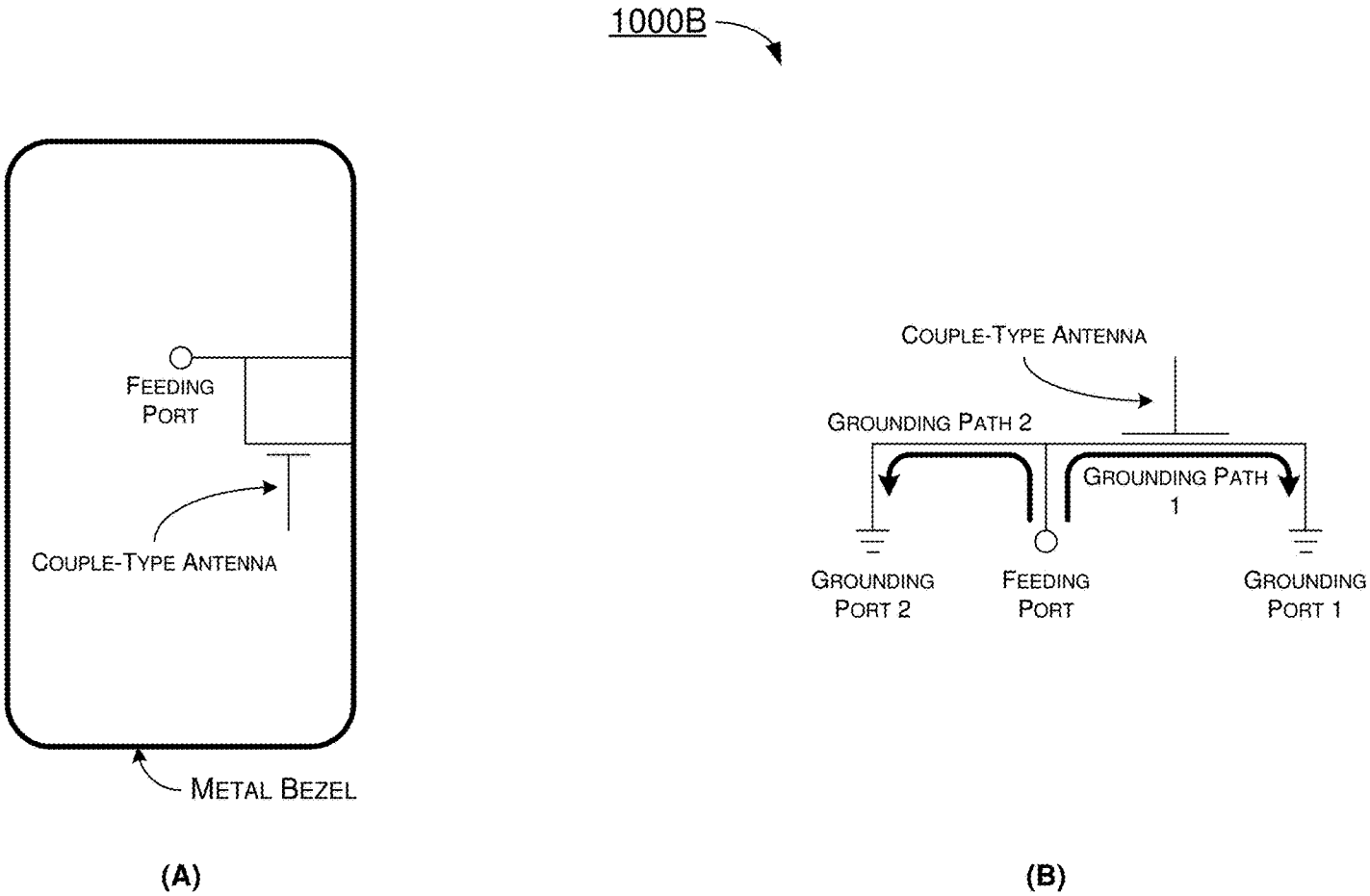
FIG. 10B is a diagram of an example design in accordance with an implementation of the present disclosure.

FIG. 10B illustrates an example design 1000B in accordance with an implementation of the present disclosure. Part (A) of FIG. 10B shows an example implementation of design 1000B in an apparatus (e.g., a portable apparatus such as a smartphone) with a closed-loop antenna having multiple grounding points of design 1000B electrically coupled to a metal bezel of the apparatus, which is connected to a system ground. Part (B) of FIG. 10B shows a schematic diagram of design 1000B.

Referring to part (B) of FIG. 10B, design 1000B may include a feeding port and two grounding ports—namely a first grounding port and a second grounding port (shown as "grounding port 1" and "grounding port 2" in FIG. 10B, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved. It is believed that design 1000B may be beneficial for mobile devices using a metal bezel since there is no need for a slit on the metal bezel as part of the antenna design.

Design 1000B may also include an electrically-conductive open-end path capacitively coupled to the closed-loop antenna. The open-end path may function as a couple-type antenna that supports the closed-loop antenna to wirelessly communication in more frequency bands.

Figure 11A:
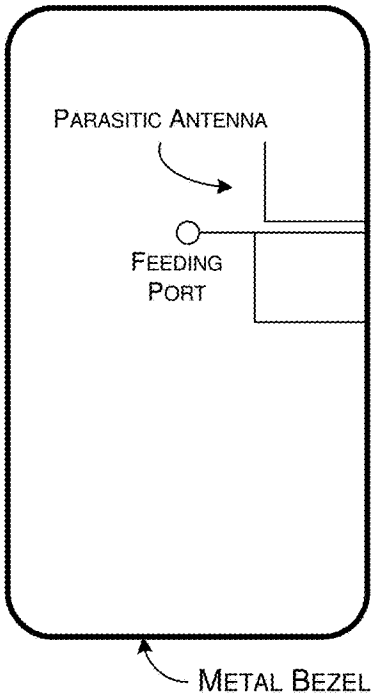
FIG. 11A is a diagram of an example design in accordance with an implementation of the present disclosure.

FIG. 11A illustrates an example design 1100A in accordance with an implementation of the present disclosure. Part (A) of FIG. 11A shows an example implementation of design 1100A in an apparatus (e.g., a portable apparatus such as a smartphone) with a closed-loop antenna having multiple grounding points of design 1100A electrically coupled to a metal bezel of the apparatus, which is connected to a system ground. Part (B) of FIG. 11A shows a schematic diagram of design 1100A.

Referring to part (B) of FIG. 11A, design 1100A may include a feeding port and two grounding ports—namely a first grounding port and a second grounding port (shown as "grounding port 1" and "grounding port 2" in FIG. 11A, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved. It is believed that design 1100A may be beneficial for mobile devices using a metal bezel since there is no need for a slit on the metal bezel as part of the antenna design.

Design 1100A may also include a co-structure with a shorted monopole adjacent the second grounding path. The shorted monopole may function as a parasitic antenna that supports the closed-loop antenna to wirelessly communication in more frequency bands.

Figure 11B:
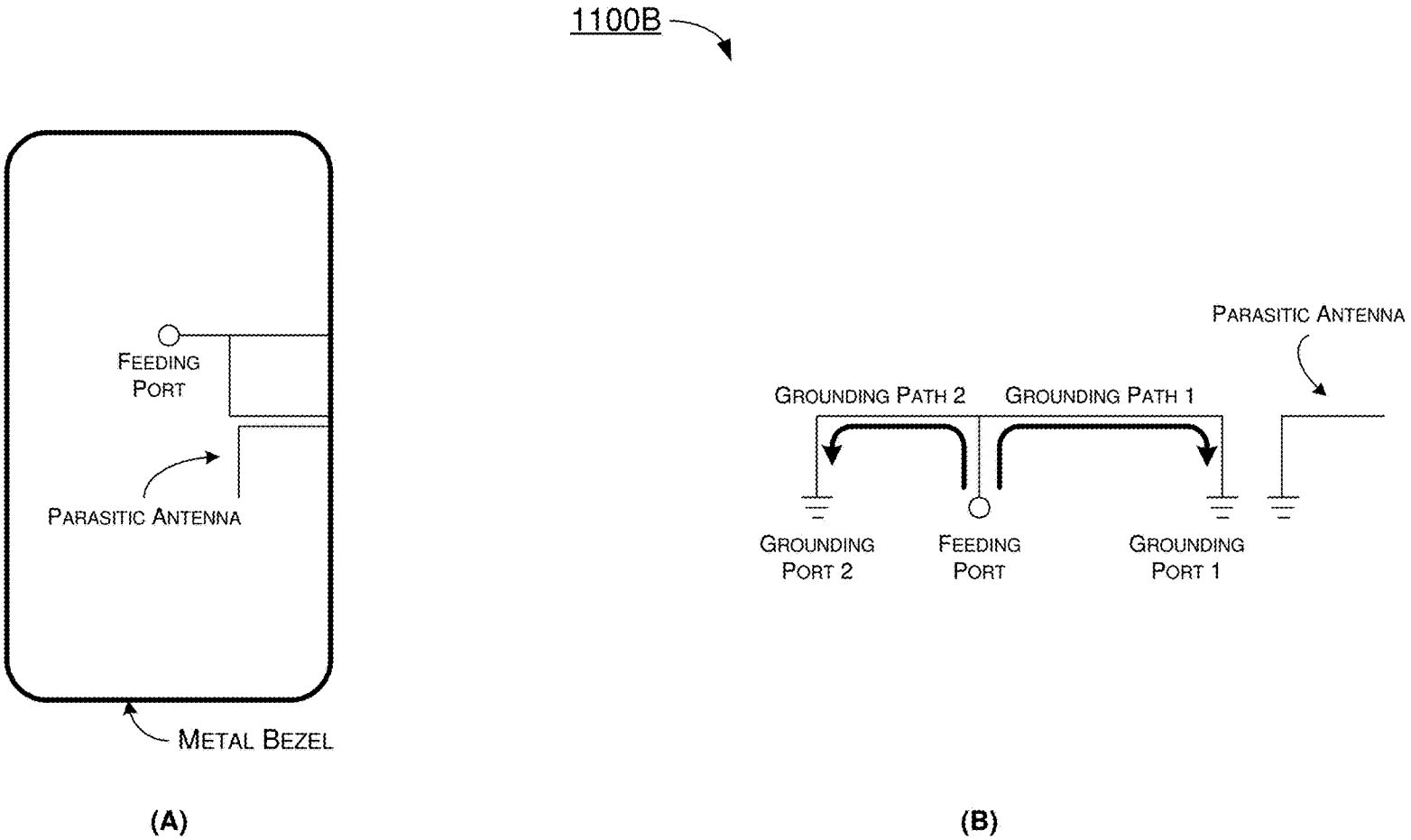
FIG. 11B is a diagram of an example design in accordance with an implementation of the present disclosure.

FIG. 11B illustrates an example design 1100B in accordance with an implementation of the present disclosure. Part (A) of FIG. 11B shows an example implementation of design 1100B in an apparatus (e.g., a portable apparatus such as a smartphone) with a closed-loop antenna having multiple grounding points of design 1100B electrically coupled to a metal bezel of the apparatus, which is connected to a system ground. Part (B) of FIG. 11B shows a schematic diagram of design 1100B.

Referring to part (B) of FIG. 11B, design 1100B may include a feeding port and two grounding ports—namely a first grounding port and a second grounding port (shown as "grounding port 1" and "grounding port 2" in FIG. 11B, respectively). A first electrically-conductive path (or a first grounding path) connected between the feeding port and the first grounding port may form a closed-loop antenna. A second electrically-conductive path (or a second grounding path) connected between the feeding port and the second grounding port may form a non-radiative closed-loop path. The length of the first grounding path is greater than the length of the second grounding path. With the second grounding path, antenna matching for the closed-loop antenna may be improved. It is believed that design 1100B may be beneficial for mobile devices using a metal bezel since there is no need for a slit on the metal bezel as part of the antenna design.

Design 1100B may also include a co-structure with a shorted monopole adjacent the closed-loop antenna. The shorted monopole may function as a parasitic antenna that supports the closed-loop antenna to wirelessly communication in more frequency bands.

Figure 12:
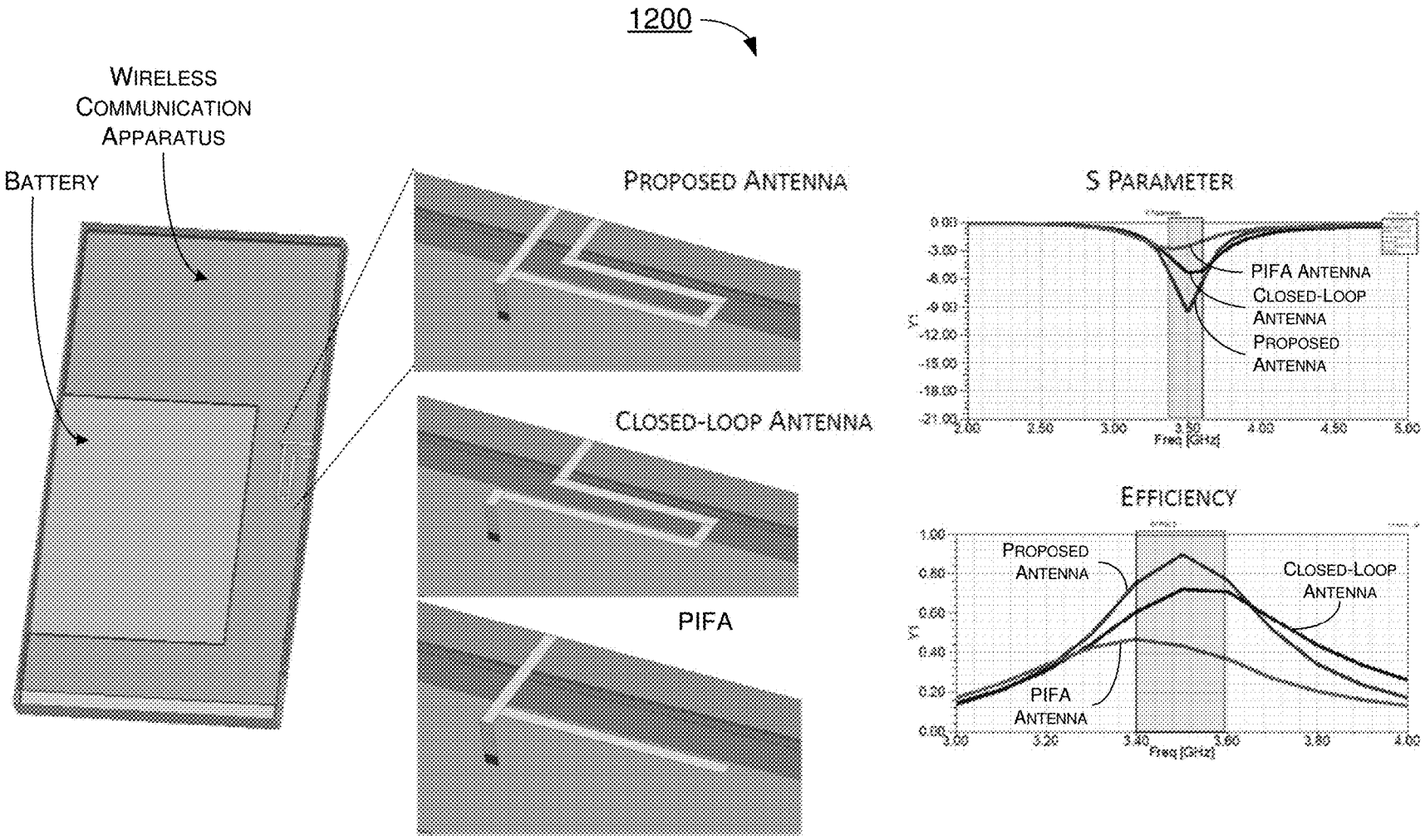
FIG. 12 is a diagram of an example scenario in which a proposed antenna in accordance with an implementation of the present disclosure is compared to conventional antennas.

FIG. 12 illustrates an example scenario 1200 in which a proposed antenna in accordance with an implementation of the present disclosure is compared to conventional antennas. As shown in FIG. 12, the proposed antenna, which is a closed-loop antenna with multiple grounding points, may be implemented in a wireless communication apparatus (e.g., a smartphone). Compared to conventional designs such as a closed-loop antenna with a single grounding point and a PIFA, the proposed antenna tends to have improved performance at least in terms of S parameter and antenna efficiency over the conventional designs.

Figure 13:
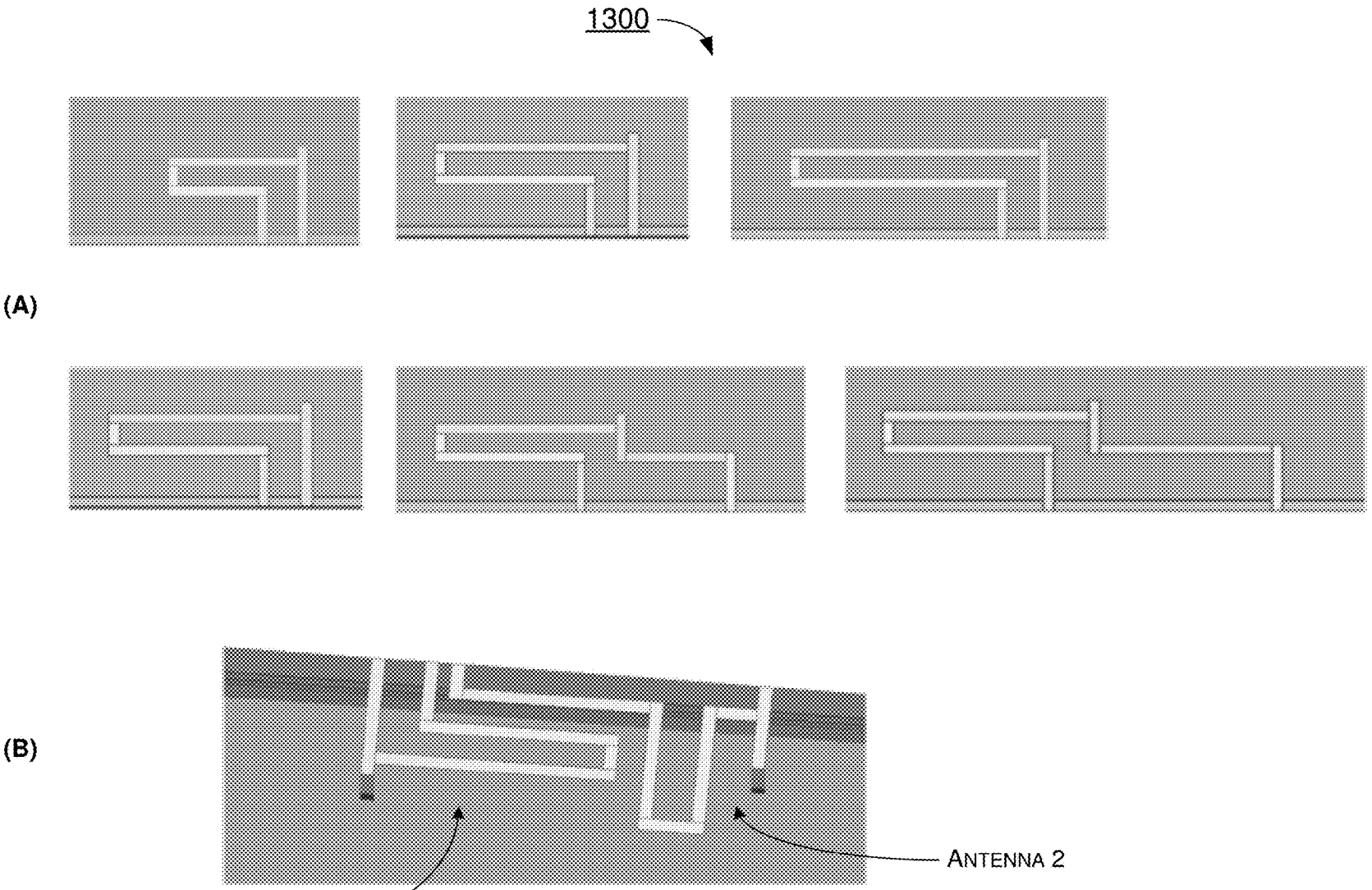
FIG. 13 is a diagram of a sampling of various designs of a proposed antenna in accordance with an implementation of the present disclosure.

FIG. 13 illustrates a sampling 1300 of various designs of a proposed antenna in accordance with an implementation of the present disclosure. Part (A) of FIG. 13 shows a number of examples of a closed-loop antenna with multiple grounding points in accordance with the present disclosure. Part (B) of FIG. 13 shows an example of utilizing two closed-loop antenna with multiple grounding points in accordance with the present disclosure, albeit having different shapes and sizes, for MIMO operations (e.g., for 5G mobile communications).

In view of the above, it is noteworthy that a closed-loop antenna in accordance with the present disclosure may include one or more first grounding paths and one or more second grounding paths. Each of the one or more first grounding paths may be a respective resonant path functioning as a respective closed-loop antenna. Each of the one or more second grounding paths may function as a respective matching tuning path. In various implementations, the design may have one feeding port or more than one feeding ports. At least one of the one or more first grounding paths and/or at least one of the one or more second grounding paths may be configured with a respective resonant circuit (e.g., one or more LC elements). At least one of the one or more first grounding paths may be configured with a switching circuit (e.g., a SPnT switch) that sets or otherwise selects one of a plurality frequency bands in which the closed-loop antenna operates. In various implementations, the design may also include an open-end path functioning as a tuning stub, a monopole antenna, a couple-type antenna, or a parasitic antenna.

Illustrative Implementations

Figure 14:
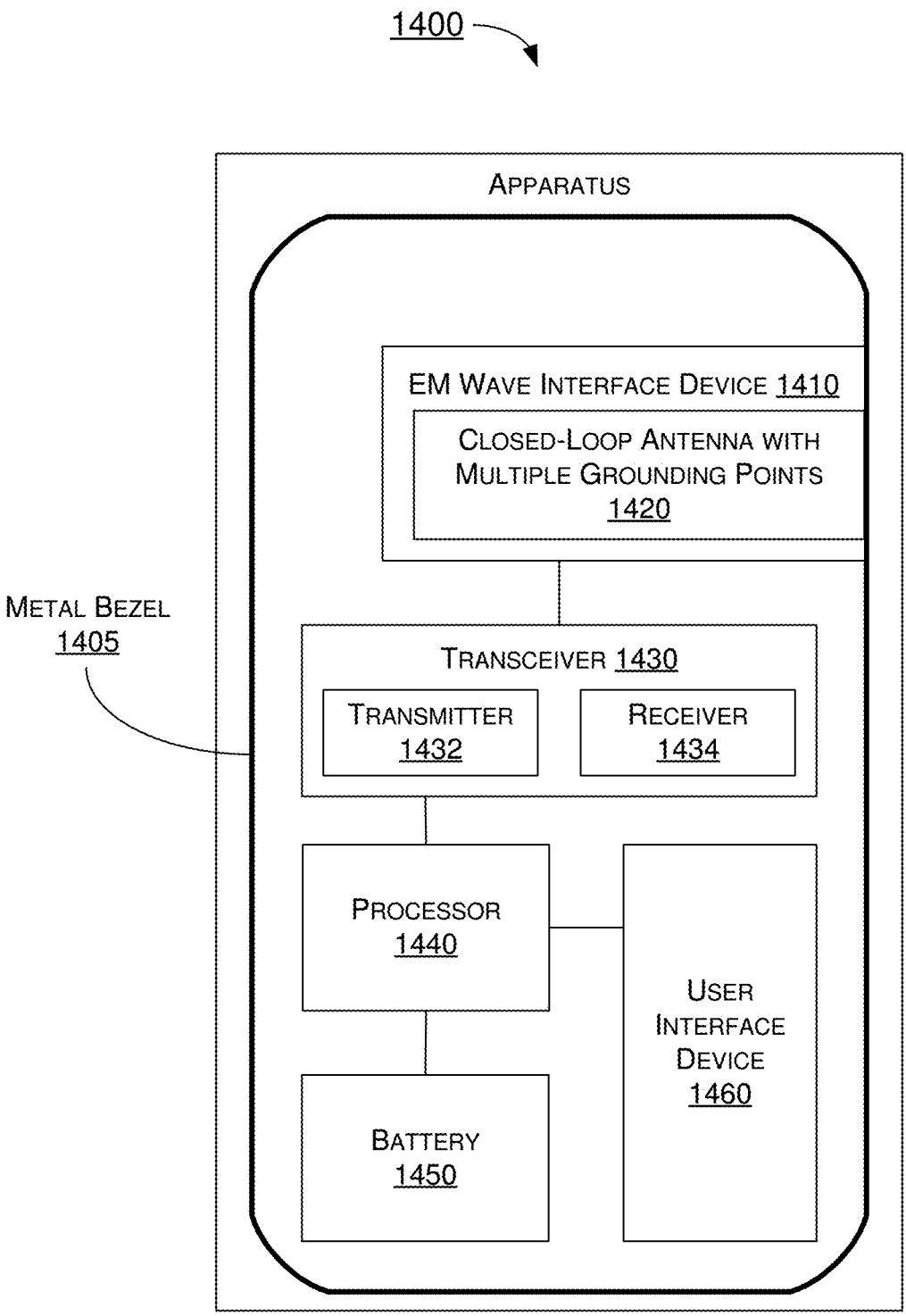
FIG. 14 is a block diagram of an example apparatus in accordance with an implementation of the present disclosure.

FIG. 14 illustrates an example apparatus 1400 in accordance with an implementation of the present disclosure. Apparatus 1400 may be equipped with a closed-loop antenna with multiple grounding points in accordance with the present disclosure. Apparatus 1400 may be a part of an electronic apparatus, which may be a user equipment (UE) such as a portable or mobile apparatus, a wearable apparatus, a wireless communication apparatus or a computing apparatus. For instance, apparatus 1400 may be implemented in or as a smartphone, a smartwatch, a personal digital assistant, a digital camera, or a computing equipment such as a tablet computer, a laptop computer or a notebook computer. Apparatus 1400 may also be a part of a machine type apparatus, which may be an IoT or NB-IoT apparatus such as an immobile or a stationary apparatus, a home apparatus, a wire communication apparatus or a computing apparatus. For instance, apparatus 1400 may be implemented in or as a smart thermostat, a smart fridge, a smart door lock, a wireless speaker or a home control center.

Apparatus 1400 may include at least some of those components shown in FIG. 14 such as an EM wave interface device 1410, a transceiver 1430 and a processor 1440. Apparatus 1400 may further include one or more other components not pertinent to the proposed scheme of the present disclosure (e.g., internal power supply, display device and/or user interface device), and, thus, such component(s) of apparatus 1400 are neither shown in FIG. 14 nor described below in the interest of simplicity and brevity.

In one aspect, processor 1440 may be implemented in the form of one or more integrated-circuit (IC) chips such as, for example and without limitation, one or more single-core processors, one or more multi-core processors, or one or more complex-instruction-set-computing (CISC) processors. That is, even though a singular term "a processor" is used herein to refer to processor 1440, processor 1440 may include multiple processors in some implementations and a single processor in other implementations in accordance with the present disclosure. In another aspect, processor 1440 may be implemented in the form of hardware (and, optionally, firmware) with electronic components including, for example and without limitation, one or more transistors, one or more diodes, one or more capacitors, one or more resistors, one or more inductors, one or more memristors and/or one or more varactors that are configured and arranged to achieve specific purposes in accordance with the present disclosure. In other words, in at least some implementations, processor 1440 is a special-purpose machine specifically designed, arranged and configured to operate with EM wave interface device 1410 in accordance with various implementations of the present disclosure. Specifically, EM wave interface device 1410 may be an example implementation of one or any combination of designs 100, 200, 300, 400, 500A, 500B, 600, 700, 800, 900, 1000A, 1000B, 1100A and 11008 described above.

In some implementations, transceiver 1430 may be capable of wirelessly transmitting and receiving data by radiating outgoing EM waves using EM wave interface device 1410 as well as sensing incoming EM waves using EM wave interface device 1410. In some implementations, apparatus 1400 may also include a battery 1450 coupled to processor 1440 and capable of powering various components of apparatus 1400. In some implementations, apparatus 1400 may further include a user interface device 1460 coupled to processor 1440 and capable of providing information (e.g., textual, audio, graphics and/or video information) to a user and receiving user inputs from the user. In some implementations, user input device 1460 may include a touch sensing panel, a sensing pad, a key board, a keypad, a tracking device, a sensor, a microphone, a speaker and/or a display panel.

In some implementations, EM wave interface device 1410 may include a feeding port, a first grounding port coupled to an electric ground, and a second grounding port coupled to the electric ground. A first electrically-conductive path (or a first grounding path) connected between the feeding port and the first grounding port may form a closed-loop antenna 1420. A second electrically-conductive path (or a second grounding path) connected between the feeding port and the second grounding port may form a non-radiative closed-loop path.

In some implementations, a length of the first electrically-conductive path may be greater than a length of the second electrically-conductive path.

In some implementations, apparatus 1400 may also include a metal bezel 1405 which is electrically connected to a system ground of apparatus 1400 to form an antenna ground. Moreover, the first grounding port and the second grounding port of EM wave interface device 1410 may be connected to metal bezel 1405.

In some implementations, EM wave interface device 1410 may also include an additional feeding port, a third grounding port coupled to the electric ground, and a fourth grounding port coupled to the electric ground. A third electrically-conductive path connected between the additional feeding port and the third grounding port may form an additional closed-loop antenna. Moreover, a fourth electrically-conductive path connected between the additional feeding port and the fourth grounding port may form an additional non-radiative closed-loop path. In some implementations, a length of the third electrically-conductive path may be greater than a length of the fourth electrically-conductive path.

Alternatively, EM wave interface device 1410 may also include a third grounding port coupled to the electric ground. A third electrically-conductive path connected between the feeding port and the third grounding port may form an additional closed-loop antenna. A length of the first electrically-conductive path may be greater than a length of the second electrically-conductive path. Additionally, a length of the third electrically-conductive path may be greater than the length of the second electrically-conductive path.

Alternatively, EM wave interface device 1410 may also include a third grounding port coupled to the electric ground. A third electrically-conductive path connected between the feeding port and the third grounding port may form an additional non-radiative closed-loop path. Moreover, a length of the first electrically-conductive path may be greater than a length of the second electrically-conductive path. Additionally, the length of the first electrically-conductive path may be greater than a length of the third electrically-conductive path.

Alternatively, EM wave interface device 1410 may also include a resonant circuit capable of matching tuning the closed-loop antenna. The feeding port may be electrically connected to the first grounding port through the resonant circuit.

Alternatively, EM wave interface device 1410 may also include a resonant circuit capable of matching tuning the closed-loop antenna. The feeding port may be electrically connected to the second grounding port through the resonant circuit.

Alternatively, EM wave interface device 1410 may also include a switching circuit capable of setting a frequency band at which the closed-loop antenna operates to be one of a plurality of frequency bands. The feeding port may be electrically connected to the first grounding port through the switching circuit. In some implementations, the switching circuit may include a single-pole multiple-throw (SPnT) switch, with n being a positive integer equal to or greater than 2. In some implementations, EM wave interface device 1410 may further include an antenna tuner capable of adaptive antenna tuning for the closed-loop antenna, with the antenna tuner coupled between the feeding port and the switching circuit.

Alternatively, EM wave interface device 1410 may also include an additional feeding port and a third grounding port coupled to the electric ground. A third electrically-conductive path connected between the additional feeding port and the first grounding port may form an additional closed-loop antenna. Additionally, a fourth electrically-conductive path connected between the additional feeding port and the fourth grounding port may form an additional non-radiative closed-loop path. In some implementations, a length of the first electrically-conductive path may be greater than a length of the second electrically-conductive path, and a length of the third electrically-conductive path may be greater than a length of the fourth electrically-conductive path. In some implementations, EM wave interface device 1410 may further include a switching circuit. In such cases, the third electrically-conductive path and the fourth electrically-conductive path may be selectively connected to either the additional feeding port or the electric ground through the switching circuit.

Alternatively, EM wave interface device 1410 may also include an electrically-conductive open-end path extending from the feeding port. The open-end path may function as a tuning stub or a monopole antenna.

Alternatively, EM wave interface device 1410 may also include an electrically-conductive open-end path capacitively coupled to the second electrically-conductive path. The open-end path may function as a couple-type antenna supporting wireless communication in multiple frequency bands.

Alternatively, EM wave interface device 1410 may also include an electrically-conductive open-end path capacitively coupled to the closed-loop antenna. The open-end path may function as a couple-type antenna supporting wireless communication in multiple frequency bands.

Alternatively, EM wave interface device 1410 may also include an electrically-conductive shorted monopole adjacent the second electrically-conductive path and functioning as a parasitic antenna supporting wireless communication in multiple frequency bands.

Alternatively, EM wave interface device 1410 may also include an electrically-conductive shorted monopole adjacent the closed-loop antenna and functioning as a parasitic antenna supporting wireless communication in multiple frequency bands.

Illustrative Processes

Figure 15:
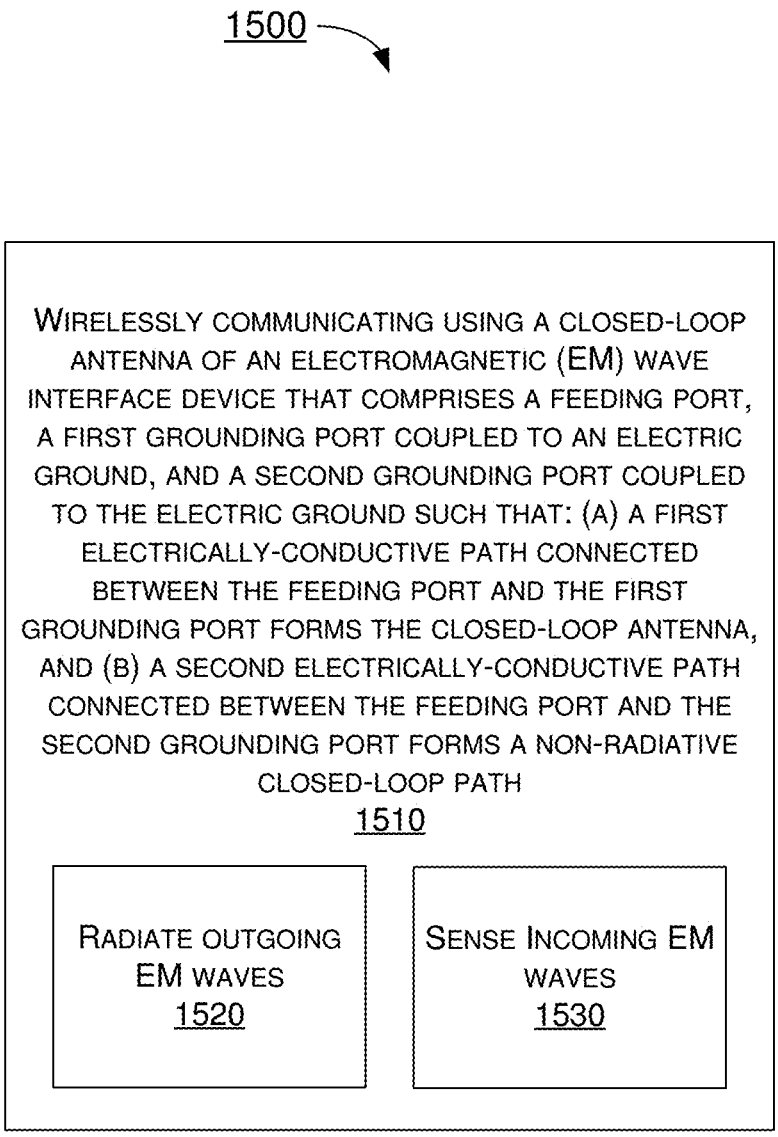
FIG. 15 is a flowchart of an example process in accordance with an implementation of the present disclosure.

FIG. 15 illustrates an example process 1500 in accordance with an implementation of the present disclosure. Process 1500 may be an example implementation of the proposed schemes described above with respect to a closed-loop antenna with multiple grounding points in accordance with the present disclosure. Process 1500 may represent an aspect of implementation of features of apparatus 1400. Process 1500 may include one or more operations, actions, or functions as illustrated by one or more of a block 1510 and sub-blocks 1520 and 1530. Although illustrated as discrete blocks, various blocks of process 1500 may be divided into additional blocks, combined into fewer blocks, or eliminated, depending on the desired implementation. Moreover, the blocks of process 1500 may executed in the order shown in FIG. 15 or, alternatively, in a different order. Process 1500 may also be repeated partially or entirely. Process 1500 may be implemented by apparatus 1400 and/or any suitable wireless communication device, UE, base station or machine type devices. Solely for illustrative purposes and without limitation, process 1500 is described below in the context of apparatus 1400. Process 1500 may begin at block 1510.

At 1510, process 1500 may involve processor 1440 of apparatus 1400 wirelessly communicating using closed-loop antenna 1420 of EM wave interface device 1410 which includes a feeding port, a first grounding port coupled to an electric ground, and a second grounding port coupled to the electric ground such that: (a) a first electrically-conductive path connected between the feeding port and the first grounding port may form the closed-loop antenna, and (b) a second electrically-conductive path connected between the feeding port and the second grounding port may form a non-radiative closed-loop path.

In wirelessly communicating, process 1500 may involve processor 1440 performing one or more operations as represented by sub-blocks 1520 and 1530. At 1520, process 1500 may involve processor 1440 using closed-loop antenna 1420 of EM wave interface device 1410 to radiate outgoing electromagnetic waves. At 1530, process 1500 may involve processor 1440 using closed-loop antenna 1420 of EM wave interface device 1410 to sense incoming electromagnetic waves. Thus, in wirelessly communicating, process 1500 may involve processor 1440 performing either or both of 1520 and 1530.

In some implementations, a length of the first electrically-conductive path is greater than a length of the second electrically-conductive path.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus, comprising:

an electromagnetic (EM) wave interface device capable of radiating and sensing EM waves, comprising:

a feeding port;

a first grounding port coupled to an electric ground;

a second grounding port coupled to the electric ground; and a third grounding port coupled to the electric ground, wherein a first electrically-conductive path connected between the feeding port and the first grounding port forms a closed-loop antenna, wherein a second electrically-conductive path connected between the feeding port and the second grounding port forms a non-radiative closed-loop path, wherein at least a portion of a third electrically-conductive path connected between the third grounding port and the feeding port or an additional feeding port is not overlapped with the first electrically-conductive path and the second electrically-conductive path, wherein the first grounding port, the second grounding port, and the third grounding port are located on a first side of a plurality of sides of the EM wave interface device such that both the closed-loop antenna and the non-radiative closed-loop path protrude from the first side of the EM wave interface device, and wherein at least a portion of the second electrically-conductive path is not overlapped with any portion of the first electrically-conductive path and the third electrically-conductive path.

2. The apparatus of claim 1, wherein a length of the first electrically-conductive path is greater than a length of the second electrically-conductive path.

3. The apparatus of claim 1, further comprising:

a metal bezel which is electrically connected to a system ground of the apparatus to form an antenna ground, wherein the first grounding port and the second grounding port are connected to the metal bezel.

4. The apparatus of claim 1, wherein the EM wave interface device further comprises:

the additional feeding port; and a fourth grounding port coupled to the electric ground, wherein the third electrically-conductive path, which is connected between the additional feeding port and the third grounding port, forms an additional closed-loop antenna, and wherein a fourth electrically-conductive path connected between the additional feeding port and the fourth grounding port forms an additional non-radiative closed-loop path.

5. The apparatus of claim 4, wherein a length of the third electrically-conductive path is greater than a length of the fourth electrically-conductive path.

6. The apparatus of claim 1, wherein the third electrically-conductive path, which is connected between the feeding port and the third grounding port, forms an additional closed-loop antenna, wherein a length of the first electrically-conductive path is greater than a length of the second electrically-conductive path, and wherein a length of the third electrically-conductive path is greater than the length of the second electrically-conductive path.

7. The apparatus of claim 1, wherein the third electrically-conductive path, which is connected between the feeding port and the third grounding port, forms an additional non-radiative closed-loop path, wherein a length of the first electrically-conductive path is greater than a length of the second electrically-conductive path, and wherein the length of the first electrically-conductive path is greater than a length of the third electrically-conductive path.

8. The apparatus of claim 1, wherein the EM wave interface device further comprises:

a resonant circuit capable of matching tuning the closed-loop antenna, wherein the feeding port is electrically connected to the first grounding port through the resonant circuit.

9. The apparatus of claim 1, wherein the EM wave interface device further comprises:

a resonant circuit capable of matching tuning the closed-loop antenna, wherein the feeding port is electrically connected to the second grounding port through the resonant circuit.

10. The apparatus of claim 1, wherein the EM wave interface device further comprises:

a switching circuit capable of setting a frequency band at which the closed-loop antenna operates to be one of a plurality of frequency bands, wherein the feeding port is electrically connected to the first grounding port through the switching circuit.

11. The apparatus of claim 10, wherein the switching circuit comprises a single-pole multiple-throw (SPnT) switch, and wherein n is a positive integer equal to or greater than 2.

12. The apparatus of claim 10, wherein the EM wave interface device further comprises:

an antenna tuner capable of adaptive antenna tuning for the closed-loop antenna, wherein the antenna tuner is coupled between the feeding port and the switching circuit.

13. The apparatus of claim 1, wherein the EM wave interface device further comprises:

the additional feeding port; and a fourth grounding port coupled to the electric ground, wherein the third electrically-conductive path, which is connected between the additional feeding port and the third grounding port forms an additional closed-loop antenna, and wherein a fourth electrically-conductive path connected between the additional feeding port and the fourth grounding port forms an additional non-radiative closed-loop path.

14. The apparatus of claim 13, wherein a length of the first electrically-conductive path is greater than a length of the second electrically-conductive path, and wherein a length of the third electrically-conductive path is greater than a length of the fourth electrically-conductive path.

15. The apparatus of claim 13, wherein the EM wave interface device further comprises:

a switching circuit, wherein the third electrically-conductive path and the fourth electrically-conductive path are selectively connected to either the additional feeding port or the electric ground through the switching circuit.

16. The apparatus of claim 1, wherein the EM wave interface device further comprises:

an electrically-conductive open-end path extending from the feeding port, wherein the open-end path functions as a tuning stub or a monopole antenna.

17. The apparatus of claim 1, wherein the EM wave interface device further comprises:

an electrically-conductive open-end path capacitively coupled to the closed-loop antenna, wherein the open-end path functions as a couple-type antenna supporting wireless communication in multiple frequency bands.

18. The apparatus of claim 1, wherein the EM wave interface device further comprises:

an electrically-conductive shorted monopole adjacent the closed-loop antenna and functioning as a parasitic antenna supporting wireless communication in multiple frequency bands.

19. A method, comprising:

wirelessly communicating using a closed-loop antenna of an electromagnetic (EM) wave interface device that comprises:

a feeding port;

a first grounding port coupled to an electric ground;

a second grounding port coupled to the electric ground; and a third grounding port coupled to the electric ground, wherein a first electrically-conductive path connected between the feeding port and the first grounding port forms the closed-loop antenna, wherein a second electrically-conductive path connected between the feeding port and the second grounding port forms a non-radiative closed-loop path, wherein at least a portion of a third electrically-conductive path connected between the third grounding port and the feeding port or an additional feeding port is not overlapped with the first electrically-conductive path and the second electrically-conductive path, wherein the wirelessly communicating comprises either or both of:

radiating outgoing electromagnetic waves; and sensing incoming electromagnetic waves, wherein the first grounding port, the second grounding port, and the third grounding port are located on a first side of a plurality of sides of the EM wave interface device such that both the closed-loop antenna and the non-radiative closed-loop path protrude from the first side of the EM wave interface device, and wherein at least a portion of the second electrically-conductive path is not overlapped with any portion of the first electrically-conductive path and the third electrically-conductive path.

20. The method of claim 19, wherein a length of the first electrically-conductive path is greater than a length of the second electrically-conductive path.

* * * * *